United States Patent [19]

Boudreau

[11] Patent Number: 4,926,966

[45] Date of Patent: May 22, 1990

[54] FOLDING SAW-HORSE

[76] Inventor: Alban M. Boudreau, 649 Rollstone St., Fitchberg, Mass. 01420

[21] Appl. No.: 422,534

[22] Filed: Oct. 17, 1989

[51] Int. Cl.[5] ..... B27B 21/00; B25H 1/06

[52] U.S. Cl. ..... 182/155; 182/225

[58] Field of Search ..... 182/155, 181–186, 182/224, 225

[56] References Cited

U.S. PATENT DOCUMENTS

| | | | |
|---|---|---|---|
| 889,494 | 6/1908 | Van Halder | 182/155 |
| 1,435,738 | 11/1922 | Reiman | 182/155 |
| 3,064,755 | 11/1962 | Illes | 182/155 |
| 4,226,301 | 10/1980 | McDaniel | 182/155 |
| 4,296,834 | 10/1981 | Kroger | 182/155 |
| 4,515,243 | 5/1985 | Prior | 182/155 |

*Primary Examiner*—Reinaldo P. Machado
*Attorney, Agent, or Firm*—Charles R. Fay

[57] ABSTRACT

A folding saw-horse including a back and a pair of leg pairs, said leg pairs being held in brackets that fix the legs in inverted V form to swing at the apexes of the V shapes on the back between useful, supporting position, and non-utile folded position relative to the saw-horse back. The inter-relation of the legs in each pair is fixed by brackets that pivot on the saw-horse back adjacent end thereof.

8 Claims, 2 Drawing Sheets

FOLDING SAW-HORSE

BACKGROUND OF THE INVENTION

There are many different saw-horses. There are those that are fixed with respect to the back and legs and can be stacked. There are those that are knock-down for shipping and storage ,and some have pivoted legs for folding. This invention discloses improvements in the last category and in addition the legs may be taken from the back of the saw-horse, although a user will often do this, because of the ease of folding and storage without dismantling.

SUMMARY OF THE DISCLOSURE

The present structure uses preferably a double back, i.e. two parallel spaced side-by-side 2"×3" or 2"×4" wooden pieces separated at each end by a part of the saw-horse leg device to attach the legs to the back of the saw-horse to support the same or to be folded upon the back for non-use storage position. Each such leg device is a fixed bracket member having means to secure a pair of legs to the back in inverted V relation and the bracket has no folding or pivoting parts in and of itself but can swing on the back by reason of the part of the leg device referred to above. Each bracket has means to fixedly attach two legs to the back, the legs being at an angle to each other and retaining the angular relation at all times. Thus when the legs in pairs are swung on the sawhorse back the legs remain in spread or V form.

PREFERRED EMBODIMENT OF THE INVENTION

Figure 2:
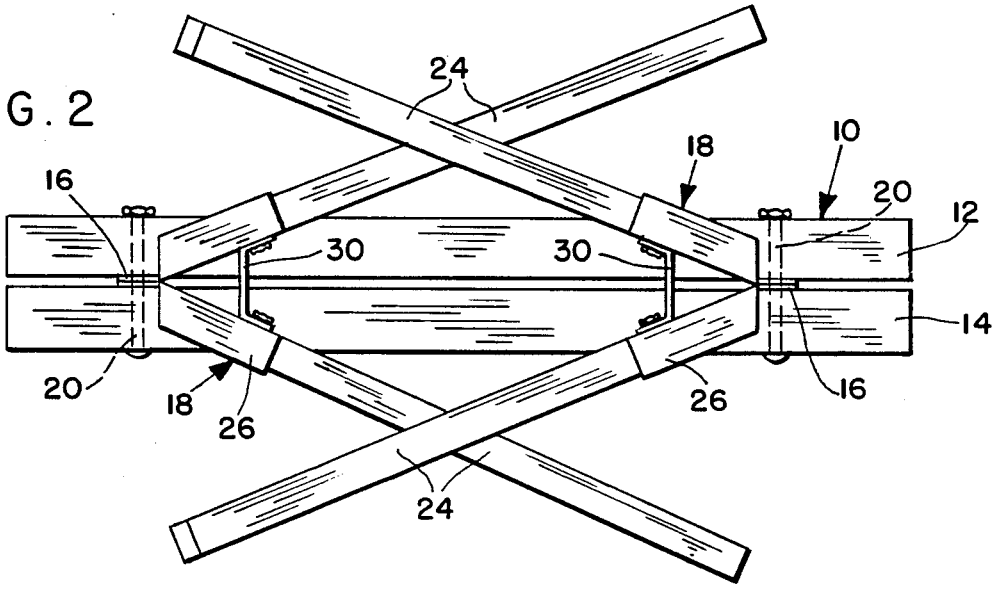
FIG. 2 is a bottom plan view showing the saw-horse folded.

The saw-horse of this invention has a back or spine 10 preferably made of two like wooden member 12, 14, FIG. 2. These members are more or less as desired or convenient. but they are best parallel, elongated, and alike strips of wood and they are very slightly spaced by a flange 16 of bracket 18 which is swingably mounted between the members 12 and 14 as by a through bolt 20. There is a like bracket at each end or end area of the members 12, 14. Flange 16 of bracket 18 is of double thickness as here shown, due to bending of the sheet metal going to make up the brackets, but of course the brackets might be cast or made some other way eliminating the double construction.

Figure 1:
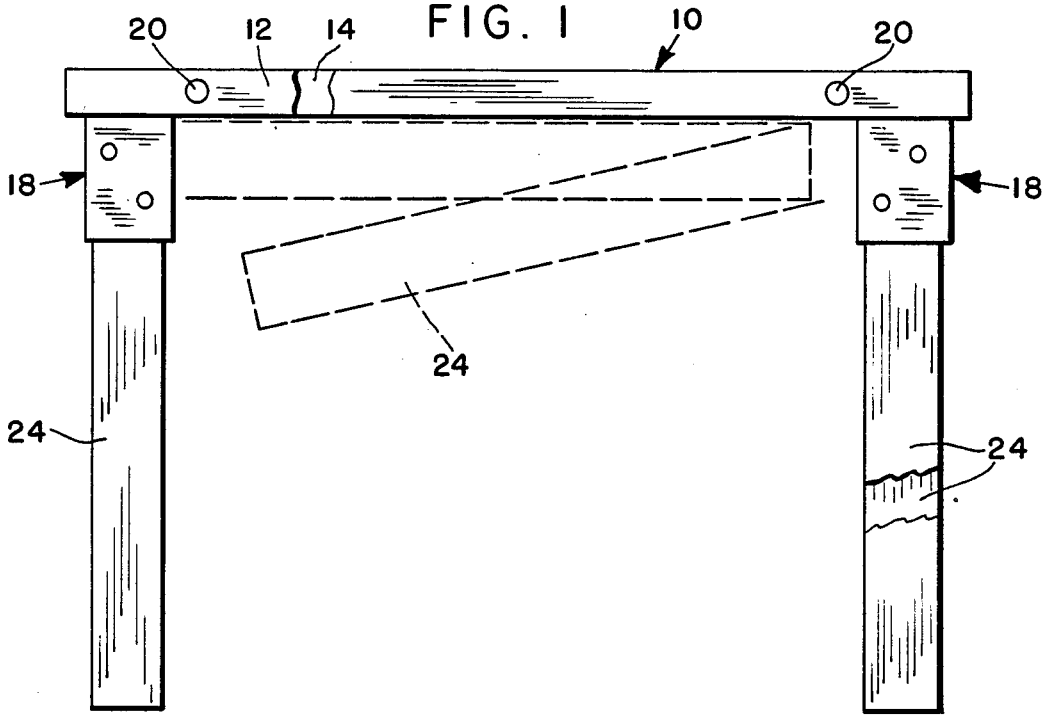
FIG. 1 is a view in side elevation showing the saw-horse set up for use in solid lines and folded for storage in dotted lines.
Figure 3:
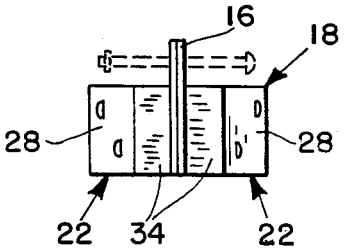
FIG. 3 is a front view of a bracket.
Figure 6:
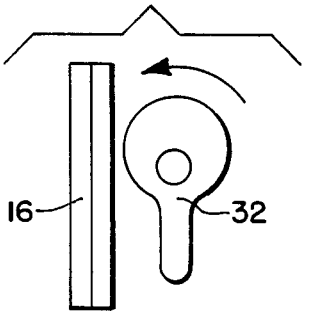
Figure 4:
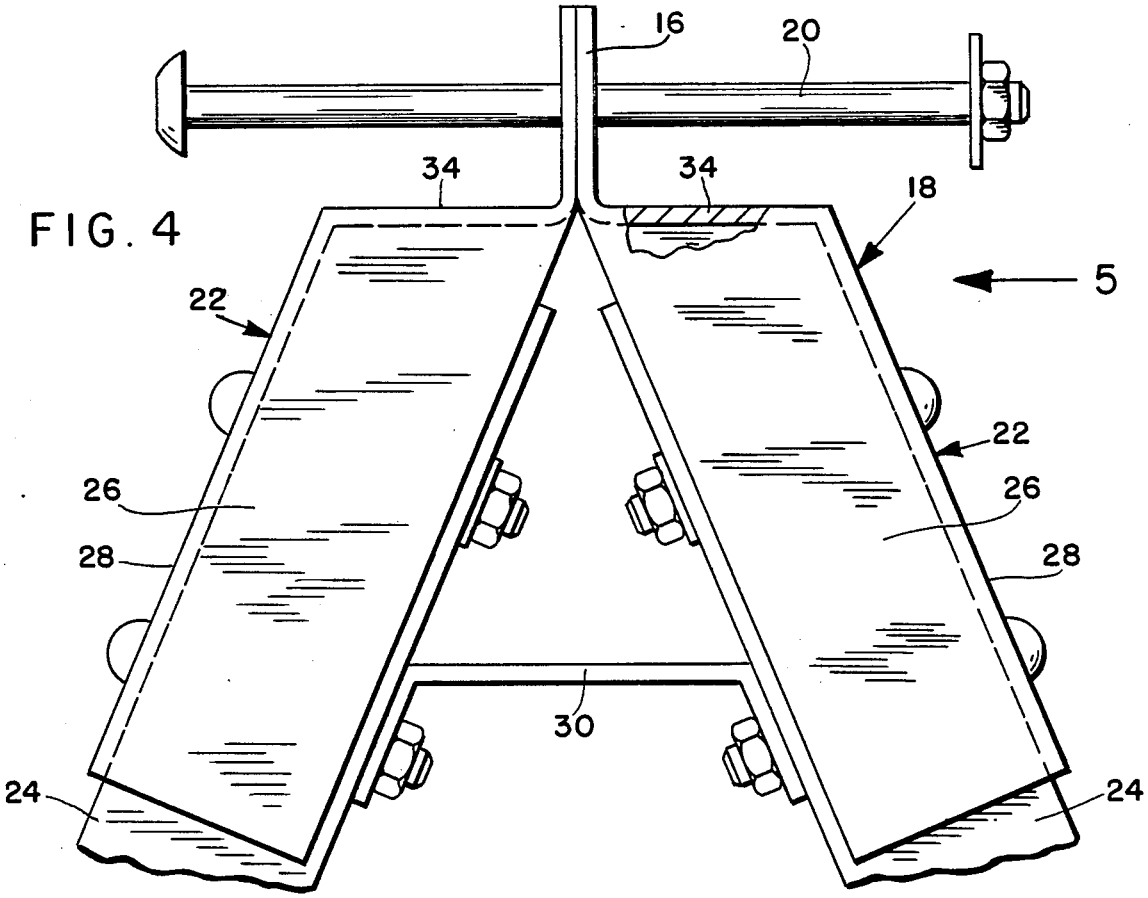
FIG. 4 is a bottom plan view of a bracket as seen if FIG. 2, but on a larger scale.
Figure 5:
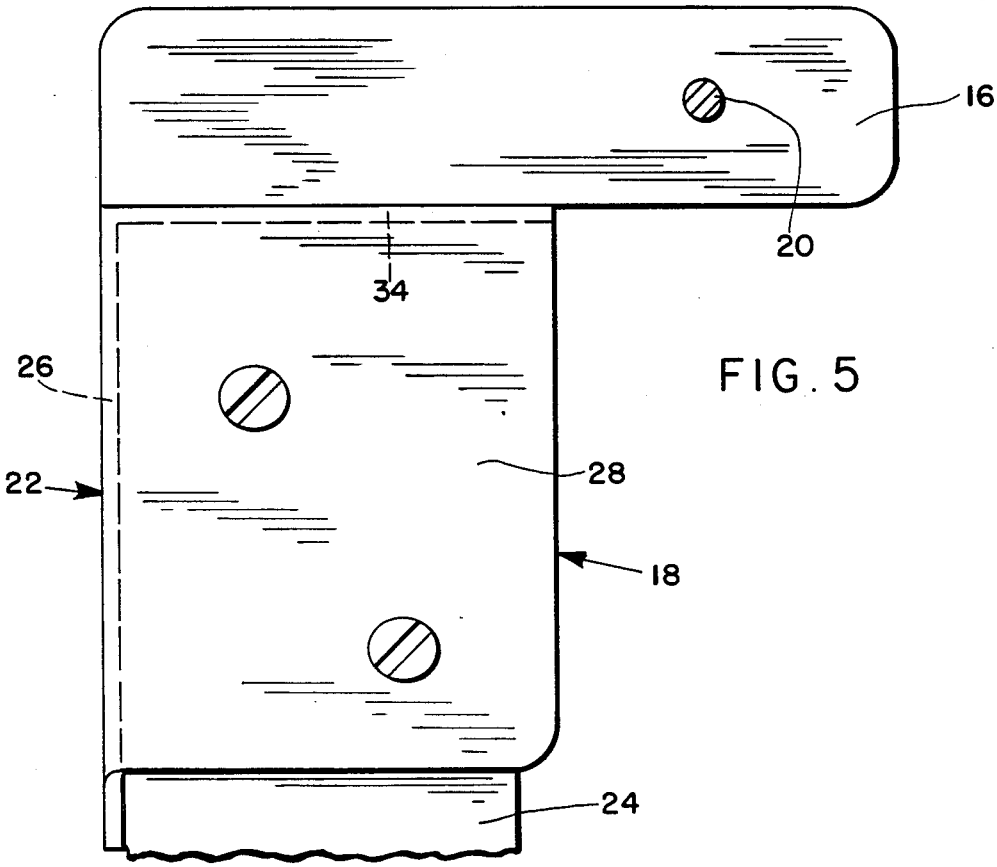
FIG. 5 is a view in side elevation of a bracket looking in the direction of arrow 5 in FIG. 4.

From the flange 16, along part of one edge thereof, there extends two leg receptors 22, see particularly FIGS. 3–5. These receptors are fastened to legs 24 by any desired or convenient means and preferably comprise two plates 26, 28, each, these plates being at an angle to each other and providing for easy and quick assembly of legs 24. As shown, the brackets are each simply folded over from a single sheet of sheet metal and are immobile inter se, that is, there is no motion of any kind, between the parts of the brackets, which swing bodily on the back or spine 10 by bolts 20, between the set up useful position in solid lines in FIG. 1 and the showing in FIG. 2 and in dotted lines in FIG. 1 wherein the legs are swung into the back or spine 10, for storage.

The legs are fixed in pairs but may have additional braces 30 to maintain this condition.

The brackets may also include a fixed end plate for each leg, as shown at 34. This strengthens the brackets and makes them more rigid as well as protecting the leg ends.

I claim:

1. A folding saw-horse comprising a back and a pair of supporting legs secured to the back adjacent each end of the saw-horse, a bracket for each pair of legs, each bracket comprising means to attach the same to the back in swinging relation, each bracket including a pair of plates for attachment to a separate leg in a diverging relation terminating in spaced free ends for the legs, each bracket being a single one-piece integral part; the leg attaching and swinging means being fixed to the plates, and the plates being divergent inter se, to hold the legs in their fixed, divergent relation at all times,

2. The saw-horse of claim 1 wherein the back comprises two elongated parallel pieces, the leg attaching and swing means including a flat flange that extends up between the two pieces, and means to pass through the flat flange and into the two pieces.

3. The saw-horse of claim 2 wherein the divergent plates form an apex and the flat flange extends therefrom.

4. The saw-horse of claim 3 wherein each divergent plate includes a part at an angle thereto that covers the end surface of the respective leg and abuts the underside of the back with the legs in unfolded, useful position.

5. The saw-horse of claim 3 wherein each leg has a flat end surface that abuts the underside of the saw-horse back when the legs are unfolded in useful saw-horse supporting condition, said legs then being arranged at an angle to the back of the saw-horse so that pressure downwardly on the saw-horse adds to pressure holding the legs in unfolded relation thereto.

6. A folding saw-horse comprising a pair of elongated closely spaced parallel back members, a pair of similar leg holding brackets, each bracket being attached to an end area of the combined members, each bracket including two divergent plates for attachment to two separate saw-horse legs, said divergent plates having an apex, and the legs lying in a single plane, a flat bracket holding flange at the apex. said bracket holding flange extending at a right angle to the plane of the legs to a location between the two back members, means to swivel the bracket holding flat flange to said back members to present the legs generally parallel to the saw-horse back or selectively to a position at a general right angle to the saw-horse back, the brackets per se being one-piece, integral stiff and rigid.

7. The saw-horse of claim 6 wherein each divergent plate of each bracket includes an extension at an angle thereto, to substantially cover two sides of the respective leg.

8. The saw-horse of claim 7 including a flat member connecting the plates and their extensions at a right angle, said extensions covering the proximate ends of the respective legs.

* * * * *